US010959497B2

(12) United States Patent
Zhang

(10) Patent No.: US 10,959,497 B2
(45) Date of Patent: Mar. 30, 2021

(54) WATERTIGHT ZIPPER

(71) Applicant: Dongguan Dingfu Zipper Technology Co., Ltd., Guangdong (CN)

(72) Inventor: Zhiqiang Zhang, Guangdong (CN)

(73) Assignee: Dongguan Dingfu Zipper Technology Co., Ltd.

( * ) Notice: Subject to any disclaimer, the term of this patent is extended or adjusted under 35 U.S.C. 154(b) by 0 days.

(21) Appl. No.: 16/681,955

(22) Filed: Nov. 13, 2019

(65) Prior Publication Data

US 2020/0221831 A1 Jul. 16, 2020

(30) Foreign Application Priority Data

Jan. 15, 2019 (CN) ..... 201910034959.X

(51) Int. Cl.
*A44B 19/32* (2006.01)
*A44B 19/34* (2006.01)

(52) U.S. Cl.
CPC ..... *A44B 19/32* (2013.01); *A44B 19/34* (2013.01)

(58) Field of Classification Search
CPC ..... A44B 19/32; A44B 19/34
See application file for complete search history.

(56) References Cited

U.S. PATENT DOCUMENTS 3,501,816 A * 3/1970 Heimberger ..... A44B 19/32 24/389
9,474,341 B2 * 10/2016 Chou ..... A44B 19/24
2002/0017010 A1 * 2/2002 Neugebauer ..... A44B 19/32 24/391
2004/0237266 A1 * 12/2004 Wang ..... A44B 19/42 24/389
2006/0282995 A1 * 12/2006 Liou ..... A44B 19/32 24/389
2007/0094852 A1 * 5/2007 Wang ..... A44B 19/32 24/389
2010/0125982 A1 * 5/2010 Chou ..... A44B 19/32 24/397
2014/0130974 A1 * 5/2014 Chen ..... A44B 19/42 156/270
2014/0359979 A1 * 12/2014 Gonda ..... A44B 19/32 24/415
2014/0366337 A1 * 12/2014 Chou ..... A44B 19/24 24/389
2018/0360172 A1 * 12/2018 Chou ..... B29C 45/14065

* cited by examiner

*Primary Examiner* — Jason W San

(57) ABSTRACT

A watertight zipper includes two zipper tapes each including: a base tape; zipper teeth arranged on the base tape, the zipper teeth on the two zipper tapes being matched with each other and capable of being engaged with each other to pull the two zipper tapes together; a first waterproof body extending to an inner side of the zipper tape, wherein in response to the two zipper tapes being pulled together, a first inner side surface of the first waterproof body of one of the zipper tapes is fit closely to a second inner side surface of the first waterproof of the other one of the zipper tapes, so that two first waterproof bodies are capable of covering over the zipper teeth together, and fit surfaces of the two first waterproof bodies laterally deviate from an engagement center line of the zipper teeth on the two zipper tapes.

15 Claims, 2 Drawing Sheets

WATERTIGHT ZIPPER

PRIORITY INFORMATION

Pursuant to 35 U.S.C.§ 119 (a), this application claims the benefit of earlier filing date and right of priority to Chinese Patent Application Number 201910034959.X, filed on Jan. 15, 2019, The entire content of Chinese Patent Application Number 201910034959.X, filed on Jan. 15, 2019, is hereby incorporated by reference.

BACKGROUND

A zipper is commonly used in clothing, luggage, and other products, and is a kind of commonly used accessory. At present, many products, especially outdoor products, have higher requirements on a waterproof performance. Therefore, more waterproof zippers appear at present. For the existing waterproof zipper, a waterproof film is usually covered on a surface layer of a cloth tape for waterproof. Although a good waterproof effect can be achieved on the cloth tape, water is still easy to pass through gaps between zipper teeth. Some zippers are also provided with a relatively thick glue layer on an inner side of the cloth tape, and waterproof can be realized by closely fitting two glue layers when the zippers are pulled together, thus having a good sealing effect. However, fit surfaces of the two glue layers of these zippers are usually coincident with an engagement center line of the zipper teeth according to a habit, and a deformation amount of the engagement center line of the zipper teeth is often the largest when the zipper is bent by an external force, thus easily causing the two glue layers to be dislocated to generate a slit, and at this time, external water is easy to permeate the zipper from the slit between the two glue layers, thus affecting a watertight effect of the zipper.

In order to solve the problem above, the disclosure is intended to provide a watertight zipper with a novel structure and a good waterproof effect.

The technical solution used to solve the technical problem in the disclosure is as follows.

There is provided a watertight zipper includes two zipper tapes each including: a base tape; zipper teeth arranged on the base tape, the zipper teeth on the two zipper tapes being matched with each other and capable of being engaged with each other to pull the two zipper tapes together; and a first waterproof body extending to an inner side of the zipper tape, wherein in response to the two zipper tapes being pulled together, a first inner side surface of the first waterproof body of one of the zipper tapes is fit closely to a second inner side surface of the first waterproof of the other one of the zipper tapes, so that two first waterproof bodies are capable of covering over the zipper teeth together, and fit surfaces of the two first waterproof bodies laterally deviate from an engagement center line of the zipper teeth on the two zipper tapes.

Preferably, the first waterproof body is an elastomer.

Preferably, a slit filler is arranged between every two adjacent zipper teeth on each of the zipper tapes, and in response to the two zipper tapes being pulled together, the slit filler is capable of being filled in a slit between the zipper teeth.

Preferably, a lower portion of the slit filler extends below a respective zipper tooth of the zipper teeth and is attached to a lower end surface of the zipper tooth.

Preferably, the zipper teeth are sewed on the base tape through a thread, and a bottom end of the slit filler is located below a bottom end of the thread.

Preferably, each of the zipper teeth has a larger portion and a smaller portion, the slit filler is located at the smaller portion, and the bottom end of the slit filler is located above or flush with a bottom end of the larger portion.

Preferably, the first waterproof body extends from an inner side of the base tape.

Preferably, an upper surface of the zipper tape is covered with a waterproof film.

Preferably, the zipper teeth are sewed on the base tape through a thread, and slits between the thread and the base tape are filled with a second waterproof body.

The disclosure has the beneficial effects that: in the disclosure, the inner side surfaces of the two first waterproof bodies can fit closely to each other when the two zipper tapes are pulled together, so that external liquid can be effectively prevented from permeating the zipper. Moreover, since a dislocation separation mode is used in the disclosure, the fit surfaces of the two first waterproof bodies laterally deviate from the engagement central line of the zipper teeth, so that a slit caused by dislocation of the two first waterproof bodies can be effectively avoided when the zipper is bent. The disclosure has a novel structure, which can effectively improve a watertight effect of the disclosure.

BRIEF DESCRIPTION OF THE DRAWINGS

The disclosure is further described in detail hereinafter with reference to the drawings and the specific embodiments.

DETAILED DESCRIPTION OF THE DRAWINGS

Figure 1:
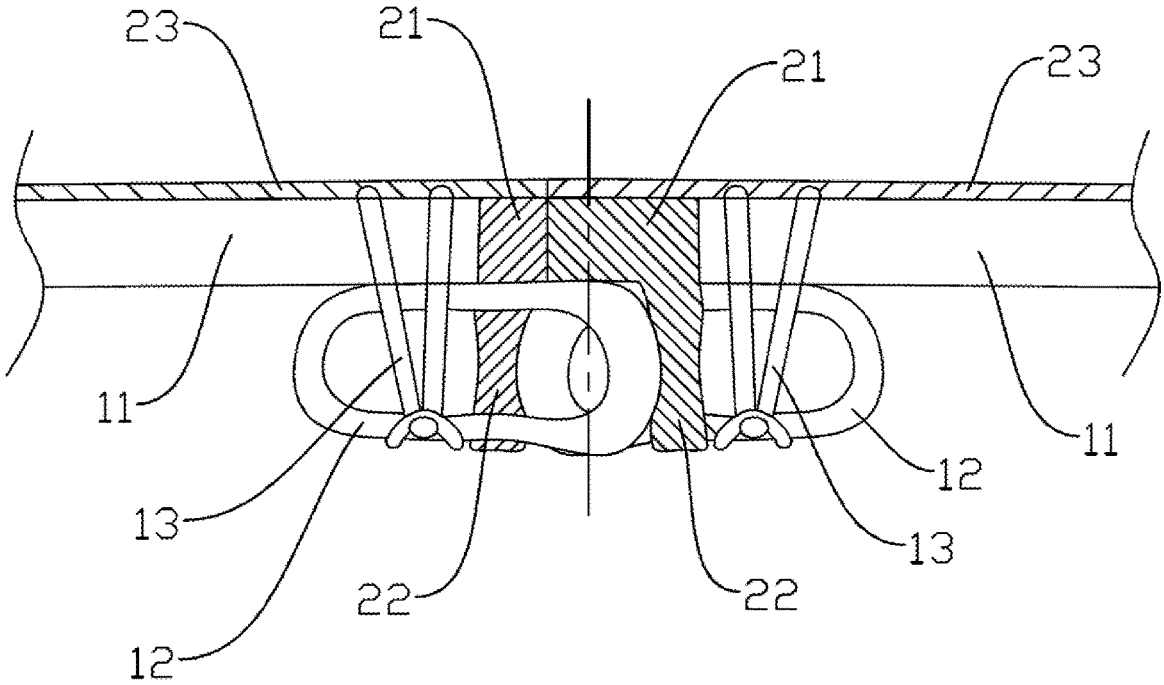
FIG. 1 is a structure diagram of the disclosure in a state of being pulled together.
Figure 2:
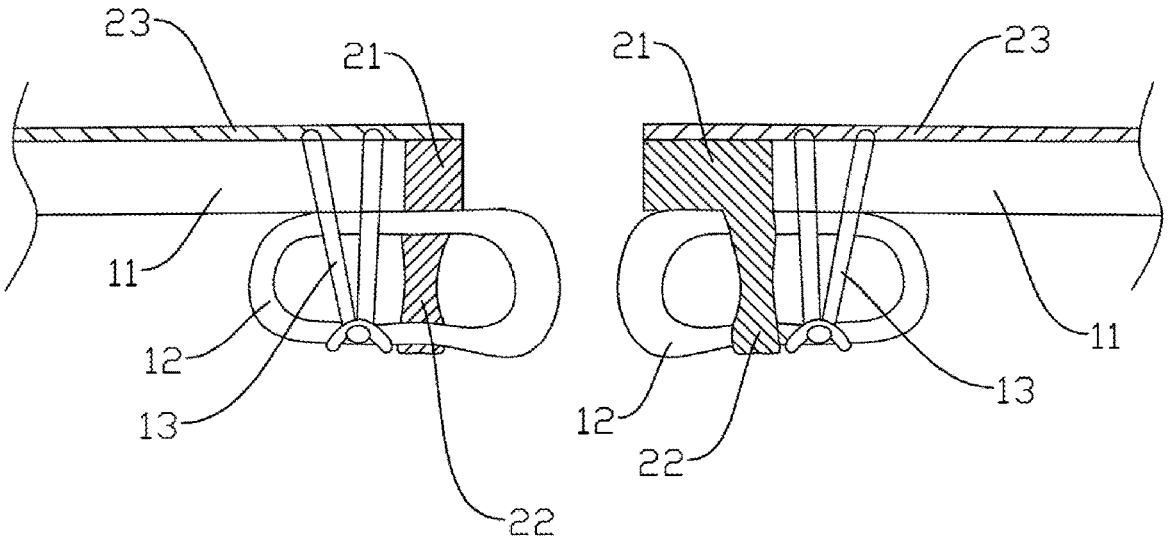
FIG. 2 is a structure diagram of the disclosure in a state of being pulled open.
Figure 3:
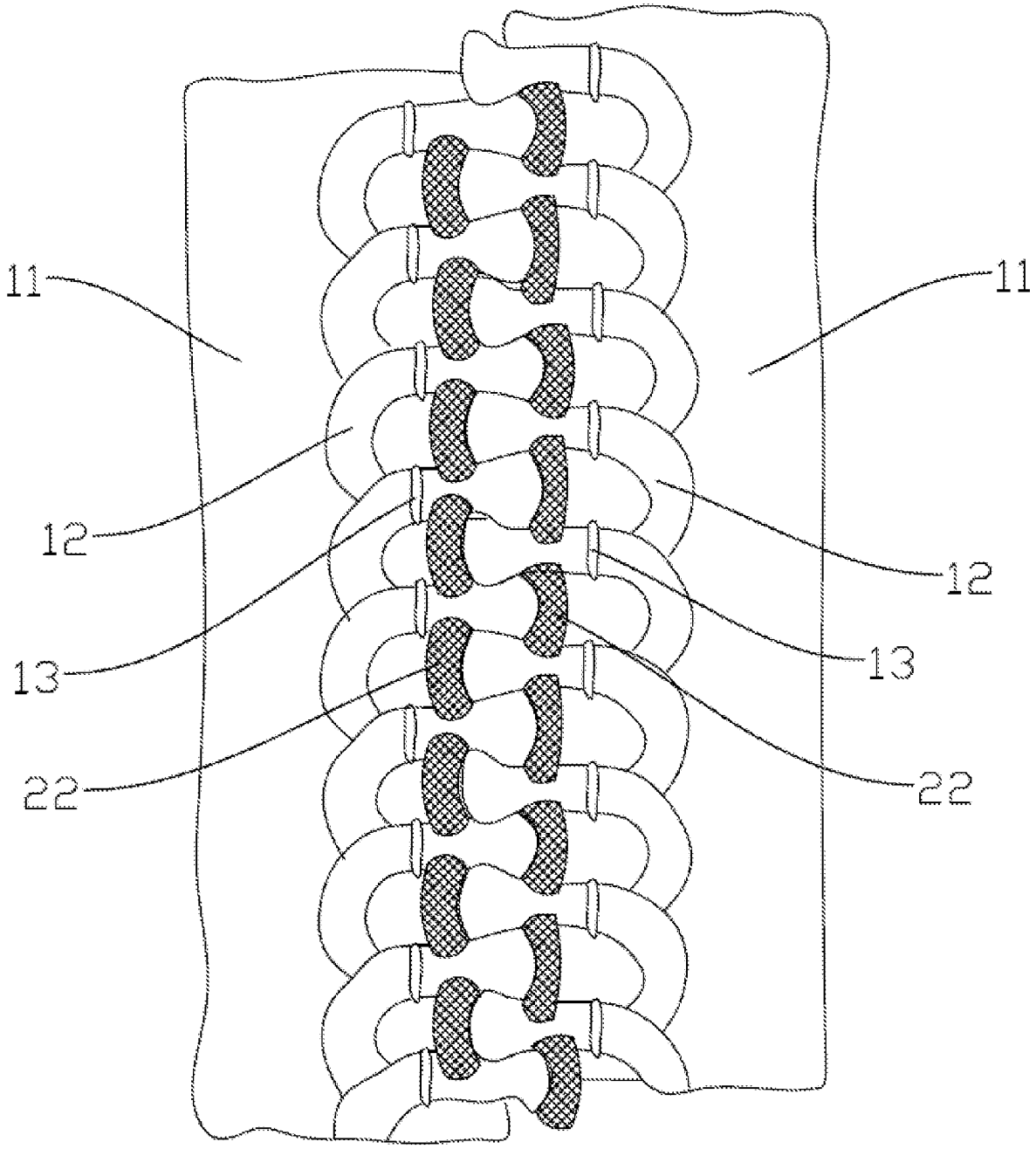
FIG. 3 is a structure diagram of a bottom portion of the disclosure.

With reference to FIG. 1 to FIG. 3, a watertight zipper includes two zipper tapes each including a base tape 11 and zipper teeth 12 arranged on the base tape 11. The zipper teeth 12 on the two zipper tapes are matched with each other and can be engaged to be pull the two zipper tapes together. The two zipper tapes are both provided with a first waterproof body 21 extending to an inner side, and inner side surfaces of the first waterproof bodies 21 on the two zipper tapes fit closely to each other when the two zipper tapes are pulled together, so that the two first waterproof bodies 21 is capable of covering over the zipper teeth 12 together, and at the time, fit surfaces of the two first waterproof bodies 21 laterally deviate from an engagement center line of the zipper teeth 12 on the two zipper tapes.

In the disclosure, the inner side surfaces of the two first waterproof bodies 21 can fit closely to each other when the two zipper tapes are pulled together, so that external liquid can be effectively prevented from permeating the zipper. Moreover, since a dislocation separation method is used in the disclosure, the fit surfaces of the two first waterproof bodies 21 laterally deviate from the engagement central line of the zipper teeth 12, so that a slit caused by dislocation of the two first waterproof bodies 21 can be effectively avoided when the zipper is bent. The zipper according to the disclosure has a novel structure, which can effectively improve the watertight effect.

In the embodiment, the first waterproof body 21 is an elastomer, which can ensure close fitting of the two first waterproof bodies 21, and is not easy to hinder the zipper from being pulled together. The first waterproof body 21 may be made of commonly used waterproof materials such as plastic, resin, rubber, etc.

A slit filler 22 may be arranged between every two adjacent zipper teeth 12 on the zipper tapes. When the two zipper tapes are pulled together, the slit filler 22 can be filled in a slit between the zipper teeth 12. In this way, after the zipper is pulled together, the slit filler 22 can be filled in the slit between the zipper teeth 12, thus preventing liquid such as water from permeating the zipper from the slit between the zipper teeth 12, and further improving a waterproof performance.

A lower portion of the slit filler 22 extends below the zipper tooth 12 and is attached to a lower end surface of the zipper tooth 12, thus being capable of forming an overhead hook that is hooked on the zipper tooth 12, so that the slit filler 22 is not easy to be moved out from the upside between the zipper teeth 12. Therefore, the zipper according to the disclosure has an improved reliability, is not easy to be damaged and is convenient to be used.

A woven zipper structure is used in this embodiment. The zipper teeth 12 are sewed on the base tape 11 through a thread 13, and a bottom end of the slit filler 22 is located below a bottom end of the thread 13 or flush with a bottom end of a larger portion. In this way, frequent friction between a zipper head or an external article and the thread 13, which may result in abrasion and breakage of the thread 13, can be avoided during use, so that a service life of zipper according to the disclosure can be effectively prolonged.

Each of the zipper teeth 12 has a larger portion and a smaller portion, the slit filler 22 is located at the smaller portion and the bottom end of the slit filler 22 is located above a bottom end of the larger portion. In this way, friction between the slit filler 22 and the zipper head or the external article can be reduced, abrasion of the slit filler 22 can be slowed down, and dislocation of the slit filler 22 caused by an external force which leads to a failure can also be avoided, so that the zipper is convenient to be used and has a prolonged service life. In this embodiment, the larger portion includes a head portion and an engagement portion of the zipper tooth 12, and the smaller portion includes a middle portion and a tail portion of the zipper tooth 12. The thread 13 is wound round the tail portion of the zipper tooth 12 to sew the zipper tooth 12 on the base tape 11, and the slit filler 22 is located at the middle portion of the zipper tooth 12. Certainly, in actual application, the smaller portion may include the head portion of the zipper tooth 12 and the larger portion may include the tail portion of the zipper tooth 12, or both ends of the zipper tooth 12 are the larger portions and the middle portion of the zipper tooth 12 is the smaller portion, etc., which can be flexibly designed and selected by those skilled in the art according to needs, and are not limited thereto.

The first waterproof body 21 extends from an inner side of the base tape 11. In this way, an upper surface of the zipper tape can be kept flat, and the first waterproof body 21 can be prevented from loosening due to a lateral external force. In actual application, the first waterproof body 21 can also extend from other positions such as an upper surface of the base tape 11, a lower surface of the base tape 11, which are not limited thereto.

An upper surface of the zipper tape is covered with a waterproof film 23, which can further improve the waterproof performance of the zipper.

The zipper teeth 12 are sewed on the base tape 11 through a thread 13, and a slit between the thread 13 and the base tape 11 may be filled with a second waterproof body, which can further improve the waterproof performance of the disclosure.

The slit filler 22, the waterproof film 23, and the second waterproof body may also be made of commonly used materials such as plastic, rubber, and resin.

In the disclosure, the first waterproof body 21, the second waterproof body and the slit filler 22 may be integrated. In an actual production process, waterproof materials such as resin and the like may be poured, by means of glue pouring, between the two base tapes 11, between the zipper teeth 12, and between the thread 13 and the base tape 11 to form the first waterproof body 21, the second waterproof body and the slit filler 22, and then a glue layer between the two base tapes 11 is dislocated and separated by a dislocation separation method. Typically, the glue layer between the two base tapes 11 may be separated by a slit according to a ratio of 1:2. In actual application, a separation position may also be flexibly adjusted according to needs, which is not limited thereto. In the production process, the first waterproof body 21 may also permeate into the tissue of the base tape 11 to improve a waterproof effect and a connection strength between the first waterproof body 21 and the base tape 11. The base tape 11 may be of a commonly used material shape such as a cloth tape, a rubber tape and the like, which are all commonly used base tape 11 materials in the field, and are not be described in detail here. Waterproof processing may also be performed on the materials of the base tape 11 to improve the waterproof performance in actual application.

In the disclosure, one side of each zipper tape facing the engagement center line of the zipper teeth 12 is taken as an inner side, and orientations such upper and lower refer to directions of the zipper during normal use, which are only for convenience of description and shall not be understood as limiting the disclosure.

Those described above are merely preferred embodiments of the disclosure, and the technical solutions achieving the objectives of the disclosure by basically the same means shall fall within the protection scope of the disclosure.

What is claimed is:

1. A watertight zipper, comprising two zipper tapes each comprising:

a first zipper base tape;

a second zipper base tape;

a first set of zipper teeth arranged on said first zipper base tape; and a second set of zipper teeth arranged on said second zipper base tape;

said zipper teeth of said first set of zipper teeth and said zipper teeth of said second set of zipper teeth being configured to engage therewith to pull said first zipper base tape and said second zipper base tape together;

said first zipper base tape including a first waterproof body extending to a first inner side of said second zipper base tape, said first waterproof body having a first inner side interface surface;

said second zipper base tape including a second waterproof body extending to a second inner side of said first zipper base tape, said second waterproof body having a second inner side interface surface;

said zipper teeth of said first set of zipper teeth and said zipper teeth of said second set of zipper teeth being configured to form a zipper engagement center line when said zipper teeth of said first set of zipper teeth engage said zipper teeth of said second set of zipper teeth to pull said first zipper base tape and said second zipper base tape together;

said first inner side interface surface being configured to interface with said second inner side interface surface, when said first zipper base tape and said second zipper base tape are pulled together, to create a waterproof body interface;

said first waterproof body and said second waterproof body being configured to overlay said zipper teeth of said first set of zipper teeth and said zipper teeth of said second set of zipper teeth when said zipper teeth of said first set of zipper teeth engage said zipper teeth of said second set of zipper teeth to pull said first zipper base tape and said second zipper base tape together;

said waterproof body interface being laterally offset from said zipper engagement center line.

2. The watertight zipper according to claim 1, wherein said first waterproof body is an elastomer.

3. The watertight zipper according to claim 1, further comprising:

a first slit filler is arranged between two adjacent zipper teeth of said first set of zipper teeth; and a second slit filler arranged between two adjacent zipper teeth of said second set of zipper teeth;

said first slit filler and said second slit filler being configured to fill in a slit between said zipper teeth of said first set of zipper teeth and said zipper teeth of said second set of zipper teeth.

4. The watertight zipper according to claim 3, wherein a lower portion of said first slit filler extends below a zipper tooth of said first set of zipper teeth and is attached to a lower end surface of the zipper tooth of said first set of zipper teeth and a lower portion of said second slit filler extends below a zipper tooth of said second set of zipper teeth and is attached to a lower end surface of the zipper tooth of said second set of zipper teeth.

5. The watertight zipper according to claim 3, further comprising:

a first thread to attached said zipper teeth of said first set of zipper teeth to said first zipper base tape; and a second thread to attached said zipper teeth of said second set of zipper teeth to said second zipper base tape;

said first slit filler being configured such that a bottom end of said first slit filler is located below a bottom end of said first thread;

said second slit filler being configured such that a bottom end of said second slit filler is located below a bottom end of said second thread.

6. The watertight zipper according to claim 5, wherein each zipper tooth of said first set of zipper teeth has a first larger portion and a first smaller portion;

each zipper tooth of said second set of zipper teeth having a second larger portion and a second smaller portion;

said first slit filler being configured such that said first slit filler is located at said first smaller portion and said bottom end of said first slit filler is located above a bottom end of said first larger portion;

said second slit filler being configured such that said second slit filler is located at said second smaller portion and said bottom end of said second slit filler is located above a bottom end of said second larger portion.

7. The watertight zipper according to claim 1, wherein said first waterproof body extends from a first inner side of said first zipper base tape.

8. The watertight zipper according to claim 1, wherein an upper surface of said first zipper tape is covered with a waterproof film.

9. The watertight zipper according to claim 1, further comprising:

a first thread to attached said zipper teeth of said first set of zipper teeth to said first zipper base tape; and a second thread to attached said zipper teeth of said second set of zipper teeth to said second zipper base tape;

a third waterproof body configured to fill slits between said first thread and said first zipper base tape; and a fourth waterproof body configured to fill slits between said second thread and said second zipper base tape.

10. The watertight zipper according to claim 1, wherein said second waterproof body is an elastomer.

11. The watertight zipper according to claim 2, wherein said second waterproof body is an elastomer.

12. The watertight zipper according to claim 1, wherein said second waterproof body extends from a second inner side of said second zipper base tape.

13. The watertight zipper according to claim 12, wherein said second waterproof body extends from a second inner side of said second zipper base tape.

14. The watertight zipper according to claim 1, wherein an upper surface of said second zipper tape is covered with a waterproof film.

15. The watertight zipper according to claim 14, wherein an upper surface of said second zipper tape is covered with a waterproof film.

* * * * *